United States Patent [19]

Miserlis

[11] 4,406,836

[45] Sep. 27, 1983

[54] METHOD FOR CONDENSING FATTY ACIDS

[75] Inventor: Constantine D. Miserlis, Arlington, Mass.

[73] Assignee: The Badger Company, Inc., Cambridge, Mass.

[21] Appl. No.: 327,122

[22] Filed: Dec. 3, 1981

[51] Int. Cl.[3] ..... C11C 1/08
[52] U.S. Cl. ..... 260/419
[58] Field of Search ..... 260/419

[56] References Cited

U.S. PATENT DOCUMENTS

| | | | |
|---|---|---|---|
| 2,430,086 | 11/1947 | Staff | 260/541 |
| 2,539,889 | 1/1951 | Bradford | 260/419 X |
| 2,664,429 | 12/1953 | Goebel | 260/419 X |
| 2,934,547 | 4/1960 | Ruddick | 260/419 |
| 3,135,322 | 6/1964 | Neugebauer | 165/158 |
| 3,173,935 | 3/1965 | Singleton | 260/419 |
| 3,629,994 | 12/1971 | Jones | 55/20 |
| 4,089,880 | 5/1978 | Sullivan | 260/424 |
| 4,345,976 | 8/1982 | Peter et al. | 260/419 X |

OTHER PUBLICATIONS

Reigel, *Chemical Processing Machinery,* 2nd Ed., 1953, pp. 501–504 and 560.

Miserlis et al., "Continuous Hydrolysis of Fats," *Chem. Engr. Prog.,* vol. 62, No. 7, pp. 114–118, (1966).

*Primary Examiner*—Helen M. S. Sneed

*Attorney, Agent, or Firm*—Hamilton, Brook, Smith and Reynolds

[57] ABSTRACT

This invention constitutes an improved method for condensing fatty acids, particularly from steam streams exiting from distillation columns. Steam streams containing entrained high-titre fatty acids can be condensed in surface condensers if certain conditions are maintained. A surface condenser, having a shell and tube configuration, is oriented in a vertical position rather than the horizontal position often employed. Quite contrary to normal processing, the cooling medium is passed through the shell side of the surface condenser and the steam stream containing entrained high-titre fatty acids is passed through the tube side. Conditions must be maintained within the tube side of the condenser so that a velocity of at least 30′ per second is provided and the steam stream must contain at least about 70% steam, by weight, in the tube side of the surface condenser.

5 Claims, 1 Drawing Figure

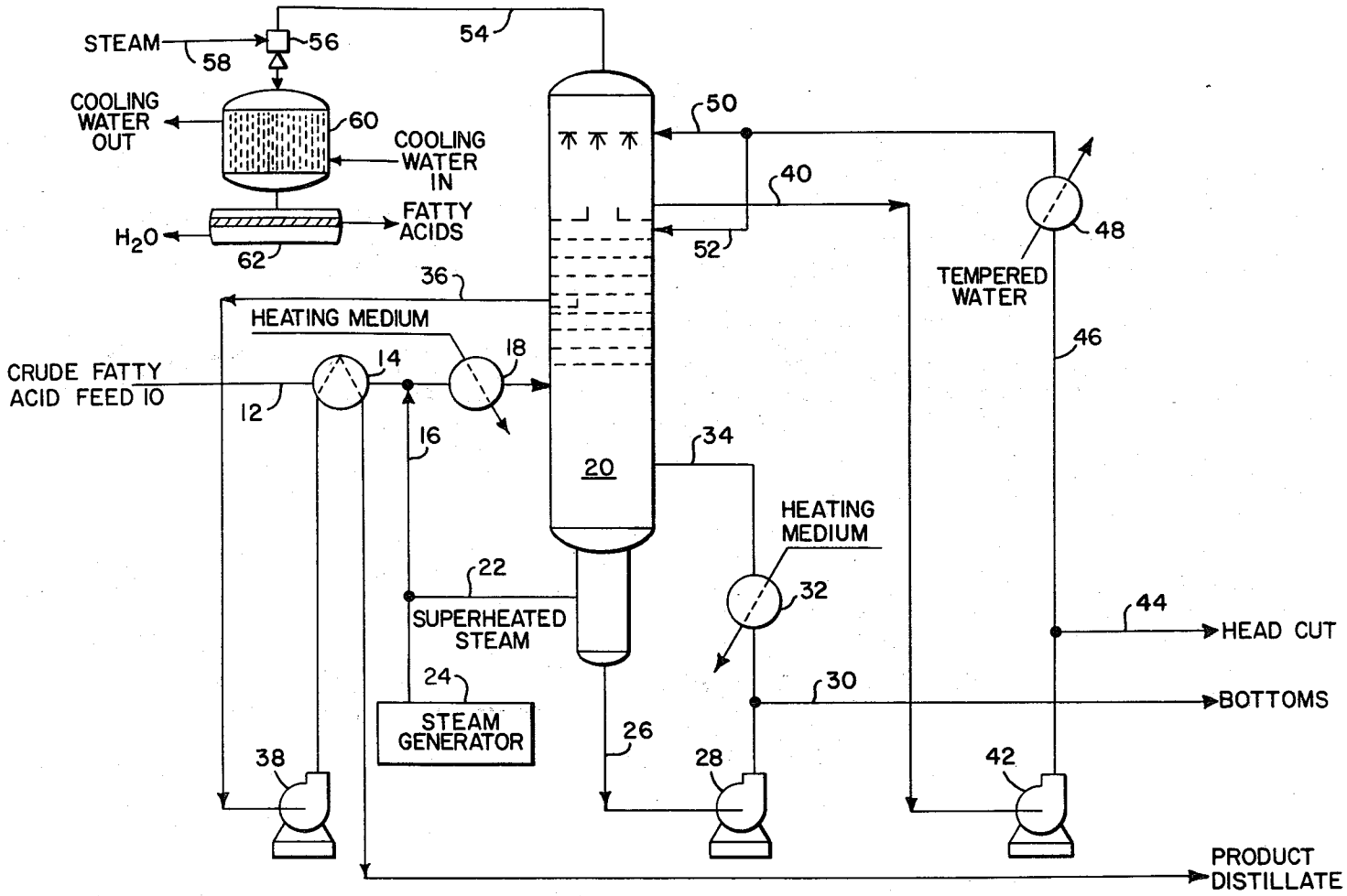
HEAD CUT
BOTTOMS
PRODUCT DISTILLATE
TEMPERED WATER
HEATING MEDIUM
SUPERHEATED STEAM
STEAM GENERATOR
COOLING WATER IN
FATTY ACIDS
STEAM
COOLING WATER OUT
$H_2O$
CRUDE FATTY ACID FEED 10
HEATING MEDIUM
12
14
16
18
20
22
24
26
28
30
32
34
36
38
40
42
44
46
48
50
52
54
56
58
60
62

METHOD FOR CONDENSING FATTY ACIDS

DESCRIPTION

1. Technical Field

This invention is in the field of fatty acids and more specifically relates to an improved method for condensing fatty acids, particularly from steam streams exiting from distillation columns.

2. Background Art

Fatty acids have become commercially important in a wide range of applications. These include the use of such fatty acids in cosmetics and toiletries, foods, soaps, synthetic detergents, textile industry applications, lubricating greases and oils, paints and protective coatings, rubber manufacture, etc.

Generally, fatty acids are derived from naturally occurring fats or oils. These fats and oils may be of animal origin, such as animal fats, or vegetable origin, such as coconut oil, cotton seed oil, tall oil, soya bean oil. Usually, the naturally occurring oils contain mixed combinations of fatty components which can be separated, purified and/or modified to various degrees for their ultimate applications.

One of the processes widely employed to selectively separate certain fatty acids from other components is fractional distillation. An example of the use of fractional distillation occurs in the manufacture of soap wherein it is often desirable to first continuously hydrolyze these naturally occurring oils and subsequently to purify certain of the fatty acid components produced by fractional distillation. A widely employed method for separating such fatty acids from hydrolyzed oils is known as a fatty acid distillation. In such a distillation, a mixture of split hydrolyzed oil and fatty acids is subjected to heat and a flow of stripping steam in a distillation column operated under vacuum so that fatty acids in the solution. Typically, vaporized fatty acids are removed as a side stream product in such a distillation and stripping steam with some entrained fatty acids is withdrawn from the distillation column as an overhead stream which is then directed to one or more condensers to condense the fatty acid components for recovery.

A major obstacle to condensation of fatty acids entrained in a steam stream from a fractional distillation column, however, is the titre or solidification point of many of the fatty acids, particularly those of higher molecular weight, such as $C_{16}$–$C_{18}$ fatty acids.Stearic acid ($C_{18}$), for example, has a titre of around 70° C., and thus, not only condenses from the steam stream but actually solidifies when most cooling media are employed. Similarly, palmitic acid ($C_{16}$) has a titre of around 63° C. Because of this, it has been widely accepted that surface condensers having a shell and tube design could not be successfully employed in the separation by condensation of fatty acids from steam streams containing entrained high titre fatty acids.

This is because it has been widely believed that efforts to condense high-titre fatty acids in surface condensers would result in fouling of the heat transfer surfaces within the condenser, thereby significantly diminishing the heat transfer required for continued efficient condensation. As condensation becomes inefficient due to fouling, a concomitant loss of vacuum occurs in the distillation tower and the overall operation becomes highly inefficient, or even worse, inoperative.

Because of the wide acceptance of the inability to employ surface condensers in fatty acid condensation, the art has previously taught that barometric-type condensers should be employed in the condensation of mixtures of steam and high-titre fatty acids. An example of the use of such a barometric condenser for condensing fatty acids is set forth in West, U.S. Pat. No. 3,622,466. West states, at column 2, lines 29–41, that condensation of fatty acid distillates from a vapor stream requires apparatus which either prohibits or substantially eliminates the possibility of the formation within the separation vessel of an emulsion of the kind that will collect on eliminator baffles necessary where the heat transfer is accomplished by the mass heat transfer principle.

In some cases, elaborate efforts have been made to overcome the problems caused by the belief that surface condensers could not be employed to condense high-titre fatty acids. One such method is presented in Sullivan, U.S. Pat. No. 4,089,880, and is described at column 11, line 18—column 12, line 6 thereof. In this system, the overhead product from a distillation column is first passed to the shell of a surface condenser which is cooled only with warm water in the temperature range of 80°–100° C. to prevent condensation and solidification of high-titre fatty acid components.Fatty acids not condensed in this surface condenser are passed to a barometric condenser which employs a fine spray of condensed and cooled fatty acids as the cooling medium according to a well known system. An example of this well-known system of the use of employing condensed and cooled fatty acids as the cooling medium to condense other fatty acid mixtures is presented in Graham et al., U.S. Pat. No. 4,188,290. Finally, the Sullivan mixture is passed through a final barometric condenser which is water-cooled to condense out the high titre fatty acids.

Although barometric condensers have proven to be generally suitable, they are not without serious problems.Recently, it has become highly undesirable, and in some cases illegal, to dispose of the cooling water employed in such barometric condensers. Although such cooling water typically contains relatively small amounts of fatty acids, it is still not usually permissible to return such contaminated streams to their natural origins without further processing to remove the small amounts of fatty acids therein.

DISCLOSURE OF THE INVENTION

Surprisingly, it has now been discovered that steam streams containing entrained high-titre fatty acids can be condensed in surface condensers if certain conditions are maintained. Initially, a surface condenser, having a shell and tube configuration, is oriented in a vertical position rather than the horizontal position often employed. Quite contrary to normal processing, the cooling medium is passed through the shell side of the surface condenser and the steam stream containing entrained high-titre fatty acids is passed through the tube side. Conditions must be maintained within the tube side of the condenser so that a velocity of at least 30′ per second is provided and the steam stream must contain at least about 70% steam, by weight, in the tube side of the surface condenser.

This use of a surface condenser provides a simple but highly efficient method of selectively separating high-titre fatty acids from a steam stream such as that exiting from a fractional distillation column. Possibly more importantly, it allows the use of water as the cooling medium without any contamination of the cooling water by the fatty acids. Thus, the cooling water can be passed to its original origin without further processing after use in the surface condenser.

Additionally, the resultant oily steam condensate is a relatively small stream, which can be decanted for recovery of the oil and reuse of the steam condensate within the process.

BRIEF DESCRIPTION OF THE DRAWING

The FIGURE is a schematic flow diagram illustrating a typical distillative separation of fatty acid components.

BEST MODE OF CARRYING OUT THE INVENTION

This invention will now be further described in more specific detail with regard to the FIGURE. Unless otherwise specified, all percentages are weight percentages.

Crude fatty acid feed 10 is passed in flow line 12 to preheater 14 which preheats the feed by heat exchange with distillation product. Preheated feed 10 is then injected with superheated steam entering line 12 through line 16. Subsequently, heated feed is passed to heat exchanger 18 heated with sufficient heating medium to vaporize feed 10.

Vaporized feed enters distillation column 20 which is provided with superheated stripping steam through line 22. Superheated steam is generated at steam generator 24. The superheated stripping steam supplied to column 20 strips fatty acids from heavy bottoms and simultaneously reduces the partial pressure of the fatty acids to allow for flashing at a lower temperature.Bottoms are withdrawn from column 20 in line 26 and pumped via pump 28 to either of two locations. One portion of withdrawn bottoms is directed by pump 28 through line 30 as bottoms product, whereas the other portion is directed through heat exchanger 32, heated with suitable heating medium, and back to column 20 via line 34 as recycled bottoms.

Product fatty acid is withdrawn in line 36 and pumped via pump 38 through preheater 14, as previously described.

Light-boiling fatty acid fraction is removed as liquid from the top tray in column 20 in line 40 and pumped by pump 42 to either line 44 as head cut or through line 46 to heat exchanger 48 wherein it is cooled with tempered water and redirected to column 20 as reflux in either of lines 50 or 52.

Process steam, with a small amount of entrained fatty acids containing noncondensables and volatile odor bodies, is removed from column 20 as overhead in line 54.Typically, the fatty acids entrained in the overhead steam stream are high-titre fatty acids such as $C_{16}$–$C_{18}$ fatty acids.

The overhead stream is passed to a steam ejector 56 powered by motive steam introduced in line 58 and then to a surface condenser 56 of the shell and tube type. Overhead is introduced into the tube side of condenser 60 and cooling medium, such as water, is introduced into the shell side. Since the cooling water does not contact the fatty acids entrained in the overhead stream, it can be reused by recycling it into the process after it exits from surface condenser 60. The condensed liquid exiting from condenser 60 is subsequently directed into decanter 62 wherein the relatively small amount of liquid is separated into an oil or fatty acid phase which can be reused in the process or discarded.

As stated above, it has been widely accepted that surface condensers could not be employed in the condensation of an overhead steam stream containing entrained fatty acids from a distillation column. However,by taking certain precautions, Applicants have discovered that surface condensers can indeed be successfully employed.

One of the precautions employed, as illustrated, is that the surface condenser must be located in a vertical orientation. Vertical orientation helps to keep the condensate flowing turbulently and with a high velocity in the tube side of the surface condenser 56.

In addition, the concentration of fatty acids is minimized by maintaining sufficient steam in the overhead to maintain at least 70%, by weight, water in this stream.

In addition, the velocity of the stream is maintained at a minimum velocity of at least 30 feet per second to insure minimum fouling of the heat transfer surfaces within the tubes of surface condenser 56.

Some of the fatty acids present in the overhead stream, such as stearic or palmitic acid, condense out as a solid in surface condenser 60. Surprisingly, however, they do not adhere to the tube walls when the condenser is operated under the conditions stated above. An emulsion containing lower molecular weight oils and water is typically formed which is easily scoured out by the high velocity maintained on the tube side of condenser 60. The resulting oil emulsion flows to decanter 62 wherein it is readily separated from the relatively large quantity of steam condensate and noncondensable stream.

The oil stream decanted away from decanter 62 can be recycled for reuse. The small condensate stream containing dissolved fatty acids may be recycled for reuse or sent to waste treatment.

Industrial Applicability

This invention has industrial applicability in the purification and processing of fatty oils and fatty acids.

Equivalents

Those skilled in the art will recognize other equivalents to the specific materials and/or steps described herein, and these equivalents are intended to be encompassed by the claims attached hereto.

I claim:

1. In a process for condensing high-titre fatty acids entrained in a steam stream by heat exchange with a cooling medium in a surface condenser having a shell side and a tube side:

The improvement comprising the combination of: (a) positioning said surface condenser in a vertical orientation; (b) passing cooling medium through the shell side of said surface condenser; and (c) maintaining conditions within the tube side of said condenser to prevent significant fouling thereof.

2. An improvement of claim 1 wherein the velocity of fluid within the tube side of said condenser is maintained at a minimum velocity of at least about 30 feet per second.

3. An improvement of claims 1 or 2 wherein the concentration of steam in said steam stream is maintained above about 70%, by weight.

4. An improvement of claim 3 wherein said high-titre fatty acids comprise $C_{16}$–$C_{18}$ fatty acids.

5. An improvement of claim 4 wherein said cooling medium comprises water.

* * * * *